US005158709A

United States Patent [19]

Setti

[11] Patent Number: 5,158,709

[45] Date of Patent: Oct. 27, 1992

[54] ELECTRIC LAMP CONTAINING MOLYBDENUM MATERIAL DOPED WTIH ALUMINUM AND POTASSIUM, MOLYBDENUM MATERIAL FOR SUCH A LAMP, AND METHOD OF ITS MANUFACTURE

[75] Inventor: Cosetta Setti, Munich, Fed. Rep. of Germany

[73] Assignee: Patent Treuhand Gesellschaft fur elektrische Gluhlampen mbH, Munich, Fed. Rep. of Germany

[21] Appl. No.: 640,692

[22] Filed: Jan. 14, 1991

[30] Foreign Application Priority Data

Feb. 1, 1990 [DE] Fed. Rep. of Germany ..... 4002973
Feb. 1, 1990 [DE] Fed. Rep. of Germany ..... 4002974

[51] Int. Cl.[5] ..... C09K 11/08; H01B 1/02

[52] U.S. Cl. ..... 252/512; 252/518; 252/301.4 R; 313/341; 428/364

[58] Field of Search ..... 252/512, 518, 492, 301.4 R; 313/341; 428/364

[56] References Cited

U.S. PATENT DOCUMENTS

| | | | |
|---|---|---|---|
| 3,661,536 | 5/1972 | Shimizu et al. | 313/311 |
| 3,676,083 | 7/1972 | Cheney et al. | 29/182 |
| 4,138,623 | 2/1979 | McMillan | 313/331 |
| 4,292,564 | 9/1981 | Kuhnert et al. | 313/318 |
| 4,322,248 | 3/1982 | Patrician et al. | 313/178 |
| 4,419,602 | 12/1983 | Mitamura et al. | 313/332 |
| 4,514,234 | 4/1985 | Fukasawa et al. | 148/115 R |
| 4,621,220 | 11/1986 | Morris et al . | 313/318 |

FOREIGN PATENT DOCUMENTS

| | | |
|---|---|---|
| 0119438 | 9/1984 | European Pat. Off. . |
| 0173995 | 3/1986 | European Pat. Off. . |
| 60-46345 | 3/1985 | Japan . |
| 60-194043 | 10/1985 | Japan . |
| 63-162834 | 7/1988 | Japan . |
| 1195740 | 6/1970 | United Kingdom . |

OTHER PUBLICATIONS

"Molybdän" ("Molybdenum") General Survey pp. 8–13, Metallwerke Plansee, 1980.

Microchimica Acta, 1987, I, pp. 437–444, article by the inventor hereof, entitle "AES Investigations of Fracture Surfaces of Aluminum Doped Sintered Molybdenum Rods".

*Primary Examiner*—Paul Lieberman
*Assistant Examiner*—Bradley A. Swope
*Attorney, Agent, or Firm*—Frishauf, Holtz, Goodman & Woodward

[57] ABSTRACT

Electrical lamps, particularly halogen lamps subjected to high temperatures and pressures, utilize a molybdenum material as holding wires, current connection leads, connecting foils and the like made of a molybdenum material of high purity, which is doped with aluminum present in a quantity of between about 80 to about 800 parts per million (ppm). If the molybdenum has a purity of at least 99.97% (by weight), aluminum may be added in a quantity of between about 150 to 800 ppm, preferably 400 to 600 ppm, and, optionally, a small amount, for example between 5 and 50 ppm, of potassium. The aluminum may, however, also include silicon besides the potassium, present in, for example, between about 270 to 600 ppm, and the potassium between 130 and 330 ppm, with the potassium content being between 0.8 to twice (by weight) of the aluminum, and the silicon content about 1.8 to 3.8, by weight, of the aluminum. The material is made by adding aluminum in an unstable compounds, for example a nitrate, to pulverized molybdenum trioxide ($MoO_3$), reducing the mixture, and then pressing the reduced mixture into a rod or bar, which is then sintered, for example in a furnace.

30 Claims, 4 Drawing Sheets

ELECTRIC LAMP CONTAINING MOLYBDENUM MATERIAL DOPED WTIH ALUMINUM AND POTASSIUM, MOLYBDENUM MATERIAL FOR SUCH A LAMP, AND METHOD OF ITS MANUFACTURE

Reference to related patent and application, assigned to the assignee of the present invention, the disclosures of which are hereby incorporated by reference:

U.S. Ser. No. 07/405,518, filed Sep. 11, 1989, Stark, now U.S. Pat. No. 4,994,707, Feb. 19, 1991.

Reference to related patents, the disclosures of which are hereby incorporated by reference:

U.S. Pat. No. 4,292,564, Kuhnert et al.

U.S. Pat. No. 4,621,220, Morris et al (to which European Patent Publication 0 150 503 corresponds);

U.S. Pat. No. 4,138,623, McMillan (to which German Patent Disclosure Document 27 46 850 corresponds);

U.S. Pat. No. 4,419,602, Mitamura et al.

Reference to related publications:

GDR Patent DD 49 592, Uhlmann

Microchim.Acta 1987, I, pp. 437–444, article by the inventor hereof, entitled "AES Investigations of Fracture Surfaces of Aluminium Doped Sintered Molybdenum Rods".

"Wolfram und Molybdän" by C. Agte/J. Vacek, Akademie-Verlag, Berlin, 1959, chapter 6, pages 61 through 135 ("Tungsten & Molybdenum").

European Patent Application 0 173 995, Westlund et al.

FIELD OF THE INVENTION

The present invention relates to electric lamps which include, within the lamp envelope, or its connecting leads, molybdenum in wire or foil form, as part of the current carrying electrical connections or as supports, and to a method of making molybdenum material e.g. suitable for incorporation in halogen-containing lamps.

DEFINITION

Molybdenum material, as generally referred to in this specification, is understood to mean raw or stock materials used for various purposes, and especially in electric lamps. The product, usually available as a sintered rod or bar, which is the final state in the manufacture thereof, is then only mechanically worked to provide the end product which is used e.g. in a lamp. The chemical composition of the material is not changed. The material for use in the lamp is obtained by rolling, swaging and drawing, to result in the material actually incorporated in the lamp. These materials are made available in the form of wires, pins or elongated thin rods. Foils, tubes or ribbons of the material to be used can be obtained by further working of the wires, pins or rods.

BACKGROUND

It is well known to dope molybdenum material with various substances. For example, doping with potassium and silicon in the form of a potassium silicate solution, has been proposed, see for example the referenced U.S. Pat. No. 4,419,602, Mitamura et al, which describes use of K and Si as additives to molybdenum for molydenum sealing foils. It is intended to, thereby, increase the re-crystallization temperature. It has been found that the characteristics of the materials of the doped molybdenum exhibit a substantial spread so that it was difficult to provide a material with precisely defined characteristics. It could be obtained only by mixing of various components in a very difficult working step, to be carried out after the material has been first prepared.

It has also been proposed to dope molybdenum material with iron and/or cobalt, see for example East German (GDR) Patent 49 592, Uhlmann. A higher breaking strain was intended to be obtained by so doping the molybdenum. In the meanwhile, however, it has been found that cobalt is a highly toxic substance requiring tight hygienic control in the workplace to protect workers handling the material. The desired and intended characteristics with respect to elongation and strength also could not be precisely predicted, since the spread of characteristics was large; manufacture, thus, resulted in substantial amounts of scrap and reject material.

The requirements placed on thermal and mechanical loading of molybdenum material have recently continuously increased, particularly in connection with the development of halogen incandescent lamps and PAR lamps. This requirement led, first, to increased specialization of the molybdenum material for specific and distinct uses. For example, different molybdenum materials were made and provided depending on the use, for example for core wires, gas-tight melt-in pins or wires, holding wires, and sealing foils, respectively. Holding or support wires must have, as the most important characteristic, high and constant elongation; sealing foils, on the other hand, must have, primarily, high ductility and high recrystallization temperature. Holding wires are used to support incandescent coiled filaments, secured at their ends—see for example the referenced U.S. Pat. No. 4,138,623, McMillan. The wires, further, must have high strength, that is, resistance with respect to breakage, and high re-crystallization temperature. Pins or wire elements which are to be melted into glass, and core wires, require an appropriate combination of high re-crystallization temperature and high flexing or bending number.

These are their most important characteristics. In pins or wire elements intended to be melted into glass, it is also important that they are free from fissures, splits and crevasses.

The various and specific requirements of these molybdenum materials can be—to some degree—obtained or controlled by respectively different constitution of the material, and/or respectively selected doping with potassium and/or, if desired, possibly also by silicon. This, however, renders machinery to make the molybdenum material extremely complex and expensive. It required new set-ups for manufacturing machinery each time a different molybdenum material was to be made, new programming thereof, and hence was costly. Since one cannot tell, merely by outside appearance what the specific constituents of any molybdenum material are, the danger of mistakes was ever present.

The problem of wide spread of characteristics was, heretofore, not solved. Continuous re-adjustment of production machinery was necessary to prevent manufacture of excessive amounts of scrap material. This was particularly so when adding the respective doping materials. The disagreeable choice presented itself, either to accept a substantial manufacture of scrap material or to use material which met the required characteristics only marginally. For example, if the material is subject to splitting or fissuring, the risk that the halogen cycle within a lamp is thereby affected by contaminants had to be accepted. Such contaminants, however, led to rapid destruction of the lamp and substantially decreased lifetimes with respect to design levels.

THE INVENTION

Briefly, it is an object to improve electric lamps using molybdenum material, and specifically to improve the molybdenum material for use therein, and decrease scrap; and to provide a method for the manufacture of such improved molybdenum material, which is rapid, simple and less expensive than prior methods, with low rejects or scrap; and, as an additional important feature, to use only materials which are non-toxic and not injurious to health in any way.

Briefly, in accordance with the invention, the lamp uses a molybdenum material which is essentially only molybdenum doped with aluminum, preferably in a quantity of between about 80 to 800 parts per million (ppm), with respect to the weight of the molybdenum material.

In accordance with a feature of the invention, the starting material is ultra-pure molybdenum, having a purity of at least 99.97%, by weight, to which aluminum is added so that the aluminum content will be between about 150 and 800 ppm, preferably between about 400 and 600 ppm. In accordance with a preferred feature of the invention, a very small amount—with respect to the aluminum—of potassium may be added, for example about 5 to 50 ppm. In this case the ultra-pure molybdenum has a purity of about 99.999%, by weight, with respect to potassium.

During the manufacturing process, aluminum does not vaporize—in contrast to potassium; thus, the addition of aluminum prevents spread, dispersion, or variance of the characteristics of the material.

The desired characteristics are obtained already by only adding a minute quantity of the aluminum, particularly within the range of 150 to 800 ppm, and preferably between 400 to 600 ppm. For manufacturing reasons, and to control the grain size, the very minor addition of potassium in the range of, preferably, between 5 to 50 ppm doping material is suitable.

Molybdenum material so made is particularly suitable as a holding wire, for use within the bulb of an electric lamp. It is especially appropriate for use when under extremely high thermal and chemical loading, which occurs in various types of lamps, such as PAR lamps and halogen incandescent lamps. As an example, a PAR lamp having a rated power consumption of 300 W, may utilize a holder for the incandescent filament made of molybdenum wire, having a diameter of about 125 micrometers, in which molybdenum is doped with 500 ppm (by weight) aluminum and 15 ppm (by weight) potassium. The molybdenum material thus is used in a high temperature environment.

In accordance with another feature of the invention, addition of predetermined quantities of aluminum can be used to bind a precisely defined quantity of potassium within the molybdenum material, particularly potassium of slightly less and up to twice, by weight, of the aluminum. Without the aluminum, potassium, as heretofore practiced, had to be excessively incorporated in the molybdenum material, since in the course of the manufacturing process, a significant portion—up to 50%—of the potassium had vaporized. The particular portion which vaporized could not be determined in advance, which, again, led to the dispersion or spread of the characteristics of the material. Aluminum prevents this evaporation, since it binds potassium in a high-temperature resistant alloy, so that predetermined characteristics will be obtained.

Silicon, also used as an additive, behaves like potassium. The addition of aluminum, particularly in the range of from about 80 to 600 ppm (by weight) and especially in the range of between 100 to 300 ppm, permits a substantial increase in constancy of the final properties and characteristics of the molybdenum material.

Adding a substantially larger quantity of aluminum, e.g. in a parts-per-thousand or parts-per-hundred region, results in a material which is no longer suitable for lamp manufacture. The stabilizing effect of potassium is masked by the gettering characteristics of the aluminum, particularly with respect to oxygen—see the article by the inventor hereof in Microchim.Acta, referenced above, I, pages 437–444. The thermal and mechanical behavior is also affected, so that it is no longer appropriate for use in lamps.

Surprisingly, it has been found that the very low quantity of doping with aluminum substantially improves the characteristics of the molybdenum material. A molybdenum material can be obtained which is superior to all known molybdenum materials. The addition of appropriate amounts of aluminum in the parts per million range even permits replacement of previously used molybdenum materials by uniform and improved molybdenum materials in accordance with the present invention, which permits lowering the cost of manufacture, since a lesser number of different materials need be made. The molybdenum material types can also be made at lower manufacturing costs, with respect to energy used during manufacture, since a specific high-temperature sintering step by passing current through the molybdenum material can be eliminated, see for example the referenced literature, chapter 6 of the book "Wolfram and Molybdän" ("Tungsten and Molybdenum"). Rather, the sintering process can be carried out in continuous sintering furnaces at substantially lower temperature than heretofore, now at about 1700° C. with respect to the previously required 2000° C.

DRAWINGS

DETAILED DESCRIPTION

Figure 1:
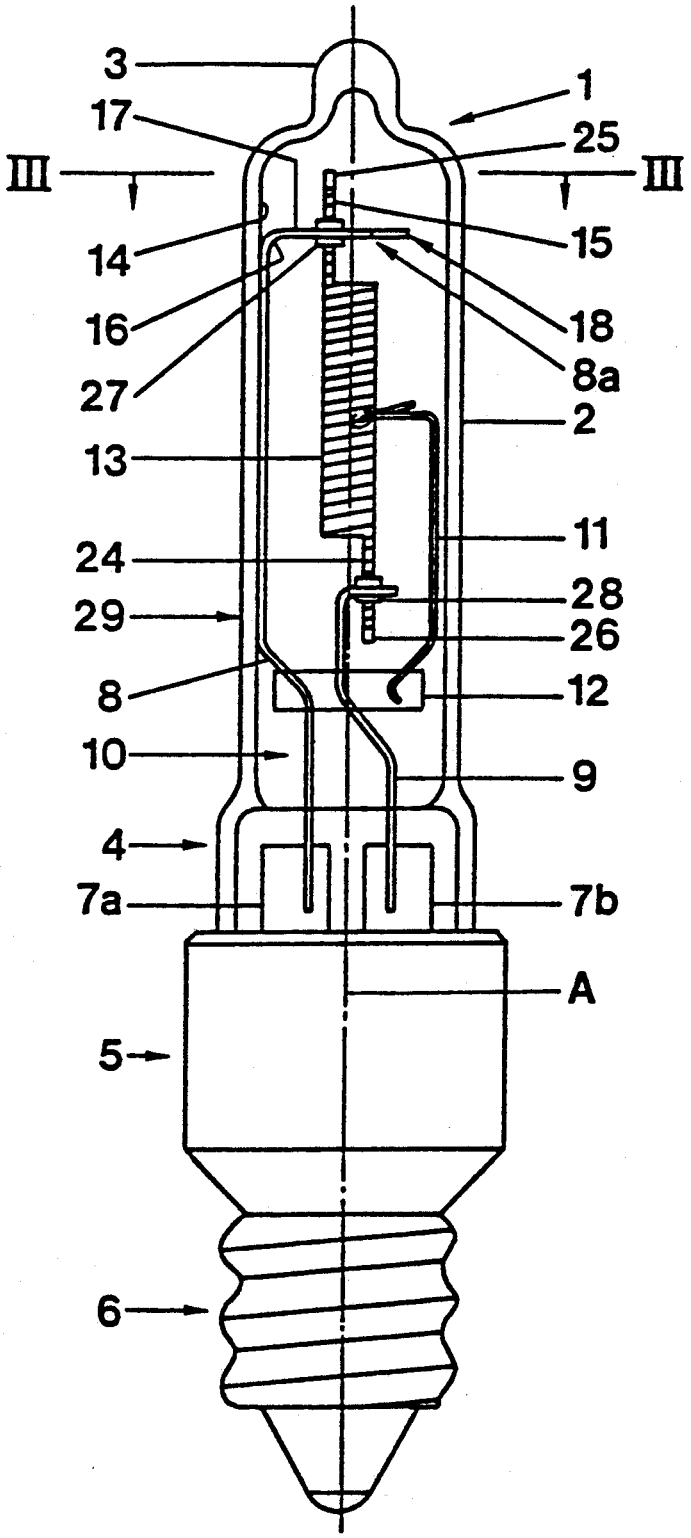
FIG. 1 is a schematic side view of a halogen incandescent lamp using molybdenum material in accordance with the present invention.
Figure 2:
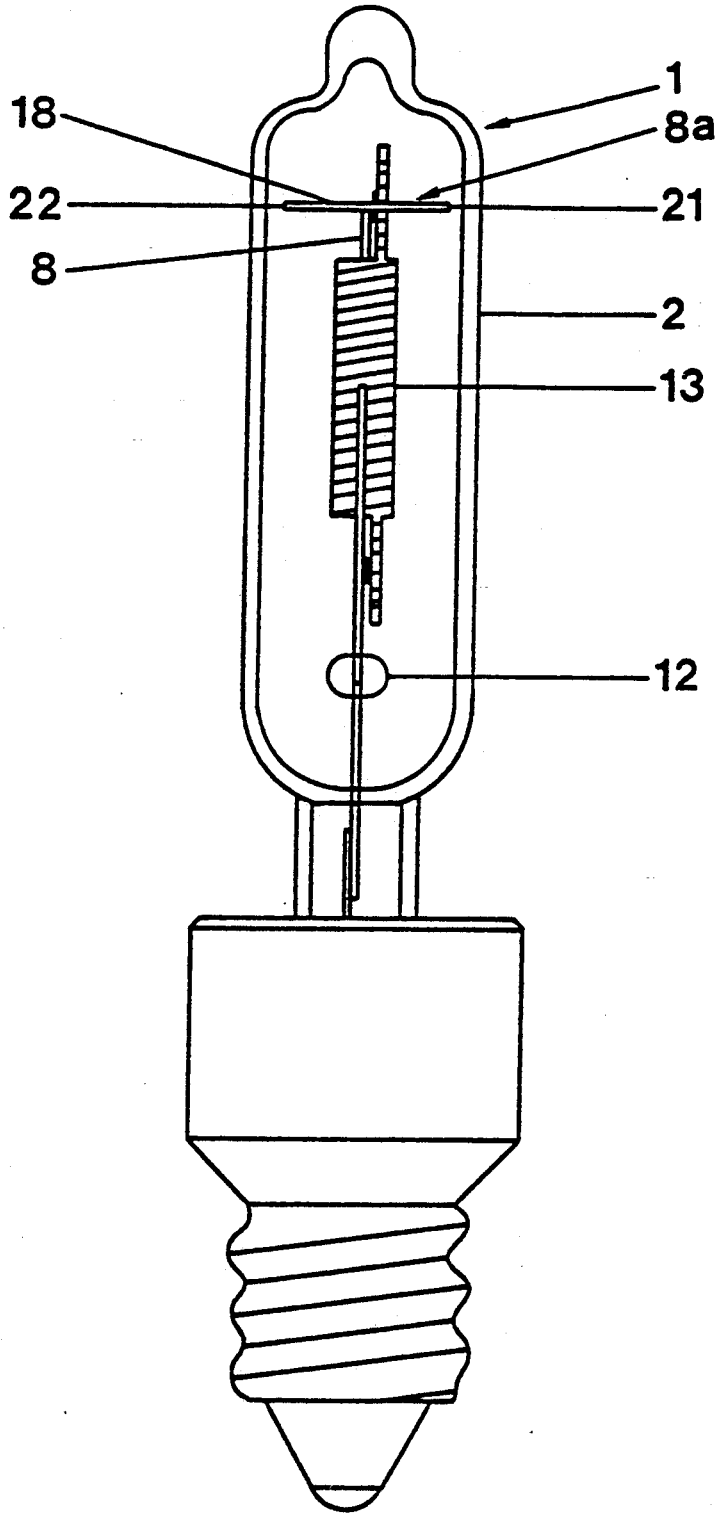
FIG. 2 is a front view of the lamp of FIG. 1, rotated by 90° with respect to FIG. 1.
Figure 3:
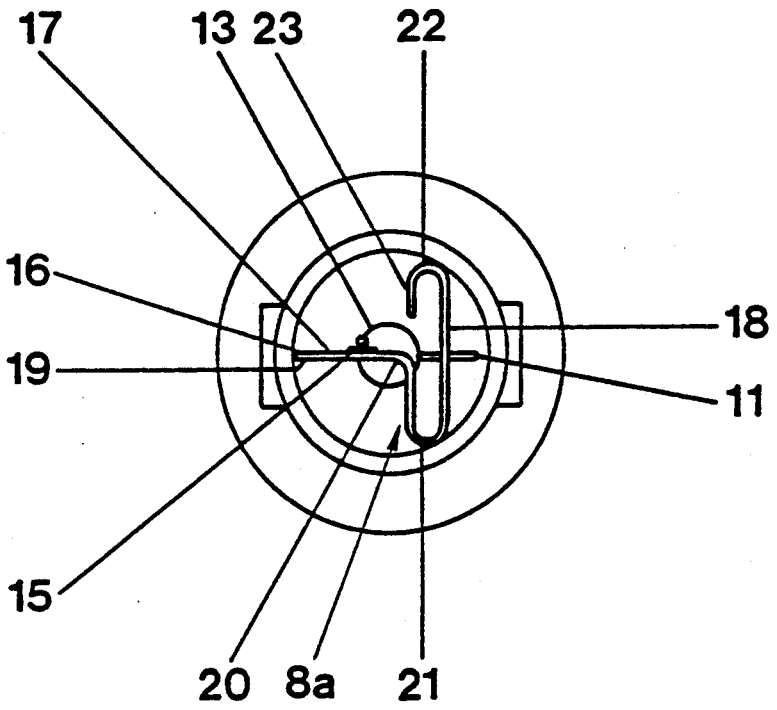
FIG. 3 is a top view of the lamp of FIG. 1, looking downwardly in the plane III—III of FIG. 1.

Referring first to FIGS. 1-3:

The side views and front views of FIGS. 1 and 2 illustrate a halogen incandescent lamp 1, designed for 110 V operation, having a rated power of 130 W. The lamp 1 has a cylindrical bulb 2 of quartz glass, formed at one end with an exhaust tip 3 at the dome thereof. It is filled with an inert gas, for example 80% Kr, and 20% $N_2$, with an additive of about 0.2% HBr, forming a halogen compound. The end at the dome is termed the remote end; the base end of the bulb 2 is closed off by a pinch or press seal 4 and connected to a ceramic base 5 having an external Edison thread 6 which, at least in part, is metallic and secured by a cement to the ceramic base 5. Two molybdenum foils *7a*, *7b* are sealed in the press seal 4. The molybdenum foils *7a*, *7b* are electrically connected to external current supply leads—not visible since hidden by the base—and connected to the thread 6 and an external central current supply button, as well known in the lamp manufacturing field. The molybdenum foils *7a*, *7b* are connected to two inwardly directed or inner current supply leads 8 and 9, e.g. of molybdenum, the foils forming electrically conductive, but vacuum-tight connections. The two inner current supply leads which, each, also could be a single, unitary tungsten wire having a diameter of about 0.34 mm, are part of a lamp mount 10. The lamp mount 10 further includes a support wire 11. The lamp mount 10, also, includes a cross element, in form of a cross beam 12, of quartz glass. The cross beam 12 holds the first current supply lead 8 and the second current supply lead 9, as well as the support wire 11 in position. The entire lamp mount, with the exception of the remote end region 8*a* of the first current supply lead 8 is located in a single plane which is intersected by the lamp axis A; further, the mount is vertically arranged in a plane through which the lamp axis passes.

The filament is a coiled-coil or double-coiled element 13 having a primary coiling of, for example, 0.42 mm outer diameter and a secondary coiling with an outer diameter of, for example, about 2.7 mm. The filament extends axially and is located, retained and maintained in position by the elements extending from the filament mount 10, namely the first and second current supply leads 8, 9 and the support wire 11.

A 45 W lamp can be similarly constructed, except that the filament will have a primary winding of 0.35 mm outer diameter and a secondary winding or coiling of 1.8 mm outer diameter. The mount for the filament can be identical to that of a 130 W lamp.

The support wire 11, e.g. of molybdenum material, is melt-connected to the cross beam or cross element 12 and electrically insulated from the current supply leads, so that it is free from voltage. It extends parallel to the filament 13 up to about a central or median portion thereof and is then hooked to a winding of the filament in a known manner.

The second current supply lead 9, starting from the molybdenum foil *7b*, extends to the quartz cross beam 12. It is slightly laterally offset or bent, and then extends in axial direction from the cross beam 12 up to the single-coil end portion 24 of the filament. Close to the end portion 24, it is bent in a 90° bend to extend transversely across the lamp for a short distance, see FIG. 1.

The first current supply 8, secured to the molybdenum foil *7a*, extends in axial direction to the cross element 12, and is there melt-connected therein. The first current supply lead 8 is offset or bent towards the inner wall surface 14 of the bulb 2.

The first current supply lead 8, e.g. made of molybdenum material, extends parallel to the inner wall surface 14 of the lamp up to about the level of the remote end 15 of the filament structure 13. At that position, the first current supply lead 8 is bent with a first bend of e.g. 90° towards the axis A of the lamp. This forms a first corner or bend point 16, in engagement with the inner wall 14 of the lamp. The current supply lead portion at the remote end is bent in a plane transversely to the axis A of the filament to form, generally, the shape of a T which is apparent from FIG. 3.

As seen in FIG. 3, which is a top view in the plane III—III of FIG. 1, the first current supply lead 8 forms a first connecting leg 17, starting at the end 19 close to the corner or bend 16, and extending to the cross bar of the T, shown generally at 18 in FIG. 3. The first connecting leg 17 is coupled at its base end 19 with the corner or bend 16 of the current supply lead 8. Preferably, the current supply lead 8 is a unitary element, but it need not be. At the head end 20 of the first connecting leg 17, it is bent in a plane transversely to the lamp axis A towards the second bend point 21 which is the first end point of the cross element 18 of the T. At that point 21, the current supply lead 8 is bent backward upon itself by 180°. The cross element 18, which forms a second connecting leg, extends up to a third corner or bend point 22, beyond which the current supply lead 8 terminates in a free end portion 23. The bend 22 and the free end portion 23 are provided to protect the inner surface of the wall of the bulb. The end portion 23 is bent back upon the cross element 18 by about 180°, towards the axis of the lamp.

The length of the first connecting leg 17 is about 80% to 90% of the length of the cross element 18 which forms a second connecting leg. The lengths of the first connecting leg and of the cross element 18, or second connecting leg, are so selected that, besides the corner 16 at the end 19 of the first leg 17, the second and third corner or bend points 21, 22 of the second connecting leg engage the inner wall surface 14 of the bulb. The length of the first connecting leg 17 is longer than the inner radius of the bulb 2, so that the first connecting leg 17 forms a tangent to or passes through the axis A of the lamp.

The three-point engagement of the remote region of the current supply lead 8 provides for centrally maintaining that section or region of the current supply lead 8 within the lamp, accurately centered therein.

ASSEMBLY OF THE LAMP

The coiled-coil filament 13 is axially aligned. The end portions 15, 24 are only singly coiled, and offset by the radius of the secondary winding from the lamp axis. They extend in parallel to the lamp axis, the end portions 15, 24 being, however, laterally offset in opposite directions with respect to the lamp axis, as is clearly seen in FIG. 1. The base end portion 24 is to the right of the lamp axis A, the remote end portion 15 to the left of the lamp axis A. The end portions 15, 24 of the filament 13 have pins 25, 26 made from tungsten inserted into the coiled winding. The pins 25, 26 fit within the inner diameter of the first coiling or winding of the end portions 15, 24, respectively of the filament.

The remote end 15 of the filament crosses the first connecting leg 17 of the first current supply lead 8. The base end 24 of the filament crosses the bent-over end of the second current supply lead 9. A thin platinum leaf or tiny platinum plate 27, 28, respectively, is inserted at the cross points of the filament ends and the respective current supply leads, e.g. if they are of tungsten.

An infrared reflective coating 29 is vapor-deposited at the outer wall surface of the bulb 2.

The respective wire portions of the mount are first bent, typically in the shape shown in FIG. 1, and melted into the cross beam 12 of quartz, so that the relative position of the current supply leads 8, 9 and support wire 11 are fixed.

The filament is then inserted into a welding die holder. The mount, pre-bent and positioned by the beam element 12 and placed in the die, and the ends of the filament, with the platinum leaves interposed, are welded together. The platinum plates or leaf elements and the inner pins 25, 26 assist in making a secure weld.

In accordance with a feature of the invention, the mount uses the molybdenum material described below. If molybdenum is used, it is not necessary to use the platinum plates 27, 28.

The fixed mount, with the filament secured thereto, is then inserted into the lamp bulb which is still open at the bottom. The bulb is then heated in the region of the pinch or press seal; the pinch seal is formed. Upon formation of the pinch or press seal, the base end of the filament is fixed in position in the bulb; the remote end of the filament is automatically centered and fixed in position by the three-point engagement at the corner or bend points of the first connecting lead 8. The bulb is then gas filled via the exhaust tube and tipped off in a known manner.

The mount structure in accordance with the present invention permits substantial reduction of deflection of the filament from the axis of the lamp, under conditions of shock, vibration, incorrect mounting or the like, when compared with known and prior art structures.

Measures were made with a 130 W lamp, having an inner bulb diameter of about 1 cm, and using molybdenum wire of 0.340 mm diameter for the current supply leads. In a vibration test, the filament deflected from the lamp axis A with the three-point engagement arrangement by a maximum of 0.25 mm. The same result was reached by using a tungsten wire. A lamp with a known holding structure, in which the entire mount is bent only in a single plane, and in which, for example, the remote end was bent in roof shape or the like, resulted in the maximum deflections of the filament, under identical vibration conditions, of 1 mm. Other prior art structures were worse.

The mount structure in accordance with the present invention improves centering of the filament in a single-ended halogen incandescent lamp by a factor of 4. This results in substantially increased efficiency of operation because the infrared reflective coating will re-heat the filament by re-directing the emitted IR radiation, after reflection, back towards the lamp axis, and hence back towards the filament, the filament being, even under vibration, retained essentially within the lamp axis.

The structure can be used for various types of lamps, and various voltages, for example for network voltages of 220–250 V. The voltage can readily be lowered, for example to a network voltage of 110 V and the effective voltage can be dropped to 84 V by serially connecting a diode with one of the current supply leads, for example located and integrated in the base.

The connecting portions 17, 18 of the filament mount at the remote end of the lamp are preferably located in a plane extending transversely to the axis A of the lamp. This is not a requirement, however, and the three-point suspension could also be obtained in a plane which is inclined with respect to the axis A of the lamp.

The connecting legs 17, 18 of the mount structure are reliably retained within the bulb 2. This is clearly apparent when one considers FIG. 3. By connecting the remote end of the filament 15 to the first connecting leg, forming the trunk of the T, deflection of the filament from the normal axial position is effectively reduced. The trunk of the T, that is, the first connecting leg 17, to which the remote end of the filament is connected, will vibrate upon shocks or vibrations, that is, a tendency to change the angle of the bend, only along the axis of the lamp. Any vibrations of the trunk are damped by the engagement of the second or third corner or bend points at the inner wall of the lamp. The first corner or bend point 16, upon vibration, will tend to cause deflection of the end section of the first current supply lead only up and down—with respect to FIG. 1—so that the filament 13 will be retained within the lamp axis. It is possible that the position of the second connecting leg 18, forming the cross element of T, can change relative to its position to the trunk or first connecting leg 18 of the T, by change of the angle between the first connecting leg 17 and the cross element 18. The change, however, does not have any effect on the filament end 15 which is secured to the first connecting leg or trunk 17 of the T. This arrangement, thus, is particularly effective in reducing excursion of the filament 13 from axis A upon shock or vibration being imparted to the lamp.

Three corners or bend points are all that is necessary to provide a stable remote portion or section or region 8*a* for the first connecting lead 8. Other configurations, with more than three engagement points against the inner wall of the lamp, may also be used and, for example, a generally cruciform arrangement is suitable. This arrangement, for some applications, may have manufacturing advantages, in that welding the filament to one of the connecting legs can be predetermined more easily.

The molybdenum material of the present invention is eminently suitable for use in the lamp of FIGS. 1–3, as well as in many other lamps, and also for other uses.

Figure 4:
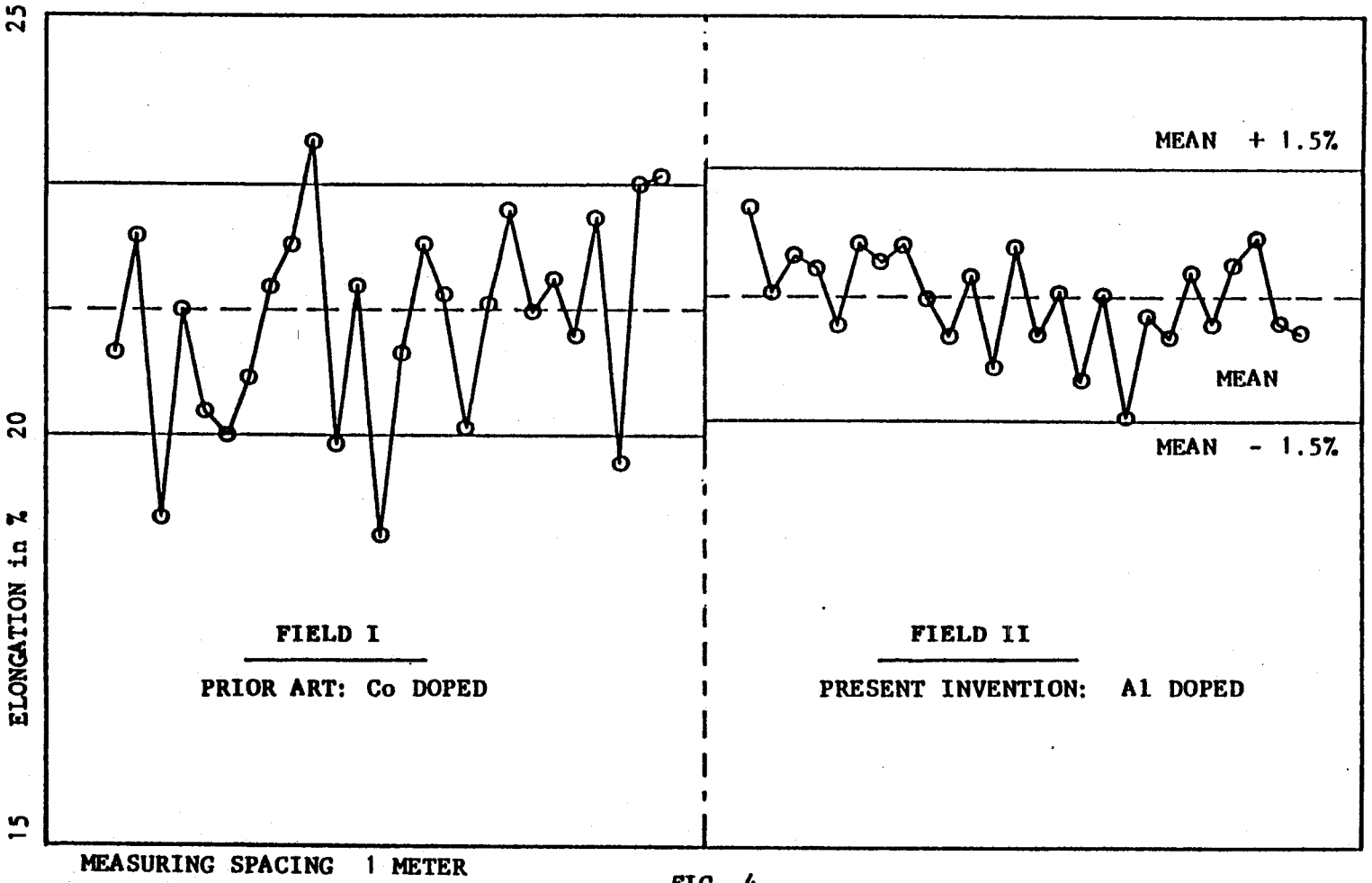
FIG. 4 is a diagram of elongation, in percent, of a molybdenum wire of the prior art, doped with cobalt, and a molybdenum wire in accordance with the present invention, the different measuring points being spaced by 1 m and shown by small circles.

FIG. 4 illustrates in the ordinate the elongation in percent, namely $\Delta L/1$ of a molybdenum wire in accordance with the invention, in comparison with the elongation of a similar wire containing cobalt. The spacing between measuring points along a wire was 1 m, and the elongation of the wire was measured from small pieces that have been cut from the wire.

In the discussion that follows, all percentages or parts are given with respect to weight.

EXAMPLE I

Ultrapure molybdenum (99.99% purity) was doped with 15 ppm K and 500 ppm aluminum.

Field I of FIG. 4 illustrates the elongation, in percent, of a molybdenum wire doped with about 500 ppm of cobalt. Field II shows the elongation of a wire in accordance with the present invention, in which the molybdenum was doped with aluminum as mentioned above. The figure clearly shows that the average elongation of the aluminum-doped wire is slightly higher than that of the cobalt doped wire and the spread of elongation at the different measuring points of the wire that were spaced 1 m, as illustrated by the respective circles in the graphs, is substantially less with the aluminum doped material. The spread or dispersion is about 2%, rather than 5% of the cobalt doped wire. Further, the re-crystallization temperature is now about 1700° C., rather than only 1100° C. in the prior art molybdenum material.

The quantity of doping depends on the eventual use of material. For reduced requirements, very low doping quantities can be used. For example, a molybdenum wire with a doping of about 250 ppm aluminum and 15 ppm potassium may be used; such a wire will have an elongation constant of about 3.5%.

For other uses, molybdenum materials may use higher amounts of potassium and/or silicon dopings.

EXAMPLE II

A molybdenum wire having a diameter of about 600 micrometers was made, having a first molybdenum material type doped as follows:

approximately 160 ppm aluminum
approximately 275 ppm potassium, and
approximately 500 ppm silicon.

The material has fissures or splits of less than 1% or, rather, is split-free to about 1%, and a flexing or bending number of 11.5.

EXAMPLE III

A second type of molybdenum wire was doped as follows:

approximately 150 ppm aluminum
approximately 150 ppm potassium, and
approximately 300 ppm silicon.

The material had about 8% splits or fissures, and a bending or flexing number of 6. The wire also had 600 μm diameter.

The two materials of Examples II and III, each, can be used for a variety of applications which, previously, required their own specific molybdenum materials.

In accordance with the present invention, specific characteristics of the material can be optimized by arranging the crystal lattice of the molybdenum material with respect to particular application, since the type of lattice structure is determinative for the characteristics of the material.

Both molybdenum materials of the Examples II and III have characteristics which are compared with prior art molybdenum materials in Table I.

TABLE I

| Properties of Material | Present Invention | Prior Art |
|---|---|---|
| Dispersion of potassium content | ±20% | ≧±50% |
| elongation Δ 1/1 (wire diameter 100 μm) | 21.5% | 21.0% |
| elongation constant (wire diameter 100 μm) | 2% | >4.5% |
| re-crystallization temperature*) | 1700° C. | 1600° C. |
| fissures*) | ≦10% | 50% |
| flexing or bending number*) | 6 and 11.5, resp. | 6 |

*) with respect to a wire diameter of 600 μm

Table I clearly shows the improvement of the characteristics of the material in accordance with the present invention, and very clearly decrease of the spread or dispersion of the potassium content.

METHOD OF MAKING THE MOLYBDENUM MATERIAL

In general, the well known Coolidge process is used, see for example "Wolfram und Molybdän" ("Tungsten and Molybdenum") referred to above.

The basic raw material is molybdenum oxide $MoO_3$ of high purity, for example and preferably of a purity of about 99.97%. This oxide, available as a powder, can be used as such or can be doped with aluminum and, if desired, a small quantity of potassium. The aluminum can be added in form of a nitrate, for example $(Al(NO_3)_3)$. Other unstable aluminum compounds such as, for example, $AlCl_3$, may be used. An aluminum compound which is highly stable, for example $Al_2O_3$, is unsuitable, since the aluminum, at the subsequent thermal treatment, would not be liberated.

Subsequently, the molybdenum oxide is subjected to a two-stage reduction in a gaseous atmosphere first of a mixture of $H_2/N_2$ and then of pure hydrogen ($H_2$). Preferably, a rotary furnace, rather than a continuous linear furnace with boats, is used. The $MoO_3$ is reduced in the two steps to $MoO_2$ and then to Mo, the first reduction step being carried out at a temperature of about 500° to 600° C. and the second, final reduction step at a temperature of between 1000° to 1100° C.

Alternatively, and if potassium and silicone are to be added, the $MoO_3$ can be reduced again in two steps, preferably in a rotary furnace, in which the first reduction step from $MoO_3$ to $MoO_2$ is carried out at a temperature of between 500° and 600° C. and the final reduction from $MoO_2$ to Mo at 1000° to 1100° C., and as before, and as known, in an atmosphere of $H_2/N_2$ for the first step and pure hydrogen in the second step.

If it is intended to obtain the material of Example II, potassium and silicon in form of an aqueous potassium silicate solution are added after the first reduction step. If it is intended to obtain the material of Example III, potassium and silicon in form of an aqueous potassium silicate solution are added in advance of the first reduction step. At the same time with the addition of the potassium silicate solution, aluminum is added in form of aluminum nitrate, $(Al(NO_3)_3)$, or in form of any other unstable aluminum compound, such as, for example $AlCl_3$.

To make the desired ductile molybdenum materials, the metal is pressed in steel matrices in a hydraulic press. Under some circumstances, and particularly if the materials of Examples II and III are to be made, a pre-sintering step is desirable. After the pre-sintering, the complete or final sintering can be obtained by passing a current of about 5000 amperes, in a sinter bell or sinter furnace, at a temperature of up to about 2000° C. This process is desirable when the doping quantities are somewhat higher—see Example II. Alternatively, sintering can be carried out with higher production capacity and lower energy costs in a traveling or continuous furnace, where a sintering temperature of about 1700° C. is suitable. Sintering in a continuous furnace at the lower temperature is entirely feasible, particularly when using the material having the very high initial purity and only low potassium content, for example between 5 to 50 ppm, with aluminum between about 400 to 600 ppm (e.g. Example I).

The sinter rods which are obtained can then be worked on by rolling, swaging and drawing to form a molybdenum wire. This wire can be used directly as a current supply wire, or a holding wire, or as an electrode, for example, or as a core wire. It may be used, for example, in vehicular halogen incandescent lamps; when used as a core wire, it is suitable in the manufacture of tungsten coils or tungsten coil filaments. Round or ribbon material for molybdenum foils, for example in accordance with Examples II and III, above, can be obtained from the molybdenum wire by further rolling; tubes can be obtained by rolling of the wire and subsequent longitudinal bending of the ribbon or tape to form a hose or tube.

It should be noted that doping of molybdenum with potassium, silicon and aluminum, for example in the range of 275 ppm of potassium, is different in kind from similar doping of tungsten with the same substances, for example of about 75 ppm of potassium. In accordance with the invention, doping of molybdenum with aluminum and, if desired, potassium and, if also desired, with silicon, has the effect of improving a substantial number of its characteristics. Doping tungsten with such materials is responsible primarily for longitudinal growth of the grains which are intended to prevent sagging of a tungsten wire, when it is heated. The powder metallurgical behavior of tungsten and molybdenum are not comparable; tungsten is sintered at 2800° C., whereas molybdenum can be sintered at substantially lower temperatures (1700° C. or 2000° C., see above). The reactions of molybdenum upon doping and upon reduction are basically different from those of tungsten. It is believed that the difference is due to the substantially lower linkage bonds of the molybdenum compounds when compared to corresponding tungsten compounds. For example, no stable $\beta$-phase will form in molybdenum during reduction, which is in contrast to the behavior of tungsten. Such a stable $\beta$-phase would permit insertion of the potassium in the crystal lattice, as is the case in tungsten. The effect of the doping of molybdenum is believed to be best characterized as a surface effect with respect to the crystal lattice, whereas with respect to tungsten, one may consider it a volume effect throughout the entire material.

Experience in treating tungsten with respect to doping by potassium, silicon and aluminum, thus, cannot be transferred to problems relating to molybdenum.

Molybdenum wires, and especially in accordance with Examples II and III above, are particularly suitable for use in vehicular halogen incandescent lamps, which have a cylindrical bulb or envelope of hard glass or quartz glass, and in which the respective incandescent filaments are held by three current supply leads, to provide separate energizing leads or conductors for high beam and low beam. Some lamps of this type also include a shade or screen. A lamp of this type is described, for example, in the referenced U.S. Pat. No. 4,292,564, Kuhnert et al. The current supply leads and, if used, the beam shade or cap, in accordance with a particularly preferred example, are made of molybdenum wire having about 150 ppm aluminum, 150 ppm potassium and 300 ppm silicon added therein. If the bulb or envelope is made of quartz glass, the molybdenum wire can be used in the form of pins or wires directly within the bulb as well as in the form of foils in a pinch or press seal. If the envelope is made of hard glass, the molybdenum wire can be used as through-pinch sealed current supply leads.

The molybdenum materials in accordance with the present invention, and particularly those of Examples II and III, can also be used in single-ended or double-ended pinch-sealed high-voltage halogen incandescent lamps. Such lamps may, selectively, have a single elongated axially extending filament; single-ended halogen incandescent lamps may include, within the vessel containing the fill, a filament which is bent in U-shape or V-shape. Such a filament must be supported at the bend of the U or the apex.

To provide such a support, a current supply lead can be supported within the bulb envelope, see for example the referenced U.S. application Ser. No. 07/405,518, Stark, filed Sep. 11, 1989, now Pat. No. 4,994,707, assigned to the assignee of the present application. In elongated lamps, for example of the type described in U.S. Pat. No. 4,621,220, Morris et al, supports for the filaments are provided which may be made of the materials in accordance with the present invention. An example of a lamp in which a U-shaped or V-shaped filament is retained at a region remote from the single base is shown in published European Patent Application 0 173 995, Westlund et al. In any one of these applications, the wire having 150 ppm aluminum, 150 ppm potassium and 300 ppm silicon is preferred.

When making a coiled wire, the coil wire is wound on a core wire made of molybdenum which, after the coil has been made, is dissolved by dipping into an acid.

Various changes and modifications may be made, and any features described herein, with respect to any material, and its use, or any process, may be used with any of the others, within the scope of the inventive concept. The use of the molybdenum material is not restricted to lamp manufacture, although the molybdenum materials of the present invention have excellent properties, making them particularly suitable for combination with glass, such as hard glass or quartz glass, for use in highly loaded high-temperature lamps.

I claim:

1. A lamp having a bulb, including a molybdenum material within said bulb, wherein said molybdenum material consists essentially ultrapure molybdenum doped with aluminum and potassium, wherein the aluminum is present between approximately 150 to 800 parts of a million (ppm), by weight; and said potassium is present in a quantity of between about 5 and 50 ppm, by weight, whereby the amount of potassium is small with respect to the amount of aluminum.

2. The lamp of claim 1, wherein said aluminum is present between about 400 and 600 ppm, by weight.

3. The lamp of claim 1, wherein said molybdenum has a purity of at least 99.97%.

4. The lamp of claim 1, wherein said molybdenum has a purity, by weight, of at least 99.97% with respect to aluminum and 99.999% with respect to potassium.

5. The lamp of claim 3, wherein said aluminum is present between about 400 and 600 ppm, by weight.

6. The lamp of claim 1, wherein said molybdenum material is in wire form, and located within said bulb.

7. The lamp of claim 5, wherein said molybdenum material is in wire form, and located within said bulb.

8. A method of making the molybdenum material claimed in claim 1 in wire, ribbon, tape and foil form suitable for use in the electric lamp, said method comprising the steps of providing a base material comprising molybdenum oxide ($MO_3$) having a purity of at least 99.97% in pulverized form;

adding aluminum in form of an unstable compound to the pulverized molybdenum oxide compound;

adding potassium in an aqueous solution to the molybdenum oxide;

reducing the molybdenum oxide and liberating the aluminum from the unstable compound to obtain a doped ultrapure molybdenum material, doped with aluminum and potassium, pressing or extruding the reduced, doped molybdenum into rod or bar form;

sintering the molybdenum in said rod or bar form at a temperature of 1700° C. in the absence of electrical current passing through said rod or bar of reduced molybdenum; and working the sintered rod or bar of said doped molybdenum to form at least one of: pins, holding wires, core wires, ribbons, tapes, foils, tubes for placement in said lamp.

9. The method of claim 8, wherein said aluminum is added in the form of aluminum nitrate.

10. The method of claim 8, wherein said step of reducing the molybdenum oxide comprises two sequential reduction sub-steps, and wherein the first reduction sub-step is carried out at a temperature lower than the second reduction sub-step.

11. The method of claim 10, wherein said step of adding said potassium comprises adding potassium in an aqueous solution to the molybdenum oxide, and said aluminum is added in form of said unstable compound after said first reduction step (Example II).

12. The method of claim 10, wherein said step of adding said: potassium in an aqueous solution to the molybdenum oxide and aluminum comprises adding said potassium in advance of said first reduction step.

13. The method of claim 10, wherein said aluminum is added in the form of aluminum nitrate.

14. The method of claim 11, wherein said aluminum is added in the form of aluminum nitrate.

15. The method of claim 12, wherein said aluminum is added in the form of aluminum nitrite.

16. A molybdenum material suitable for use in a high temperature environment, especially for use within a halogen incandescent lamp, wherein said molybdenum material essentially consists of ultrapure molybdenum doped with aluminum and potassium, wherein the aluminum is present between approximately 150 to 800 parts million (ppm), by weight; and said potassium is present in a quantity of between about 5 and 50 ppm, by weight, whereby the amount of potassium is small with respect to the amount of aluminum.

17. The material of claim 16, wherein said aluminum is present between about 400 and 600 ppm, by weight.

18. The material of claim 16, wherein said molybdenum has a purity of at least 99.97%.

19. The material of claim 16, wherein said molybdenum has a purity, by weight, of at least 99.97% with respect to aluminum and 99.999% with respect to potassium.

20. The material of claim 19, wherein said aluminum is present between about 400 and 600 ppm, by weight.

21. The material of claim 16, wherein said molybdenum material is in wire, ribbon, tape or foil, or tubular form.

22. The material of claim 18, wherein said molybdenum material is in wire, ribbon, tape or foil, or tubular form.

23. A method of making the molybdenum material claimed in claim 16 in wire, ribbon, tape and foil form suitable for use in the high-temperature environment, especially for use within the halogen incandescent lamp, said method comprising the steps of providing a base material comprising molybdenum oxide ($MO_3$) having a purity of at least 99.97% in pulverized form;

adding aluminum in form of an unstable compound to the pulverized molybdenum oxide compound;

adding potassium in an aqueous solution to the molybdenum oxide;

reducing the molybdenum oxide and liberating the aluminum from the unstable compound to obtain a doped ultrapure molybdenum material, doped with aluminum and potassium, pressing or extruding the reduced, doped molybdenum into rod or bar form;

sintering the molybdenum in said rod or bar form at a temperature of 1700° C. in the absence of electrical current passing through said rod or bar of reduced molybdenum; and working the sintered rod or bar of said doped molybdenum to form at least one of: pins, holding wires, core wires, ribbons, tapes, foils, tubes for placement in said lamp.

24. The method of claim 23, wherein said aluminum is added in the form of aluminum nitrate.

25. The method of claim 23, wherein said step of reducing the molybdenum oxide comprises two sequential reduction sub-steps, and wherein the first reduction sub-step is carried out at a temperature lower than the second reduction sub-step.

26. The method of claim 25, wherein said step of adding said potassium comprises adding potassium in an aqueous solution to the molybdenum oxide, and said aluminum is added in form of said unstable compound after said first reduction step (Example II).

27. The method of claim 25, wherein said step of adding said potassium in an aqueous solution to the molybdenum oxide and aluminum comprises adding said potassium in advance of said first reduction step.

28. The method of claim 25, wherein said aluminum is added in the form of aluminum nitrate.

29. The method of claim 26, wherein said aluminum is added in the form of aluminum nitrate.

30. The method of claim 27, wherein said aluminum is added in the form of aluminum nitrate.

* * * * *